United States Patent [19]

Matsuda

[11] 4,349,004

[45] Sep. 14, 1982

[54] EXHAUST GAS RECIRCULATION APPARATUS FOR DIESEL ENGINE

[75] Inventor: Hiroshi Matsuda, Sakado, Japan

[73] Assignee: Nissan Diesel Kogyo Kabushiki Kaisha, Ageo, Japan

[21] Appl. No.: 199,413

[22] Filed: Oct. 22, 1980

[51] Int. Cl.[3] ..... F02M 25/06

[52] U.S. Cl. ..... 123/569; 123/571

[58] Field of Search ..... 123/568, 569, 571

[56] References Cited

U.S. PATENT DOCUMENTS 3,916,857 11/1975 Naito et al. ..... 123/569

4,075,994 2/1978 Mayer et al. ..... 123/568

4,280,470 7/1981 Ueda ..... 123/569

*Primary Examiner*—Wendell E. Burns

*Attorney, Agent, or Firm*—David G. Alexander

[57] ABSTRACT

A predetermined amount of exhaust gas recirculation is constantly provided through a first passageway (21) connected between an engine intake manifold (12) and an exhaust manifold (13). A vacuum actuated valve (19) constitutes a second passageway which is connected in parallel with the first passageway (21). The valve (19) is opened to allow exhaust gas recirculation through the second passageway except during idling and heavy load operation of an engine (11), thereby preventing excessive emission of smoke under these conditions.

1 Claim, 3 Drawing Figures

COMP
TURBINE
V/P
11
12
13
14
16
17
18
19
21
22
23
24
26
27
28
29
31
32
33
34
36
37
38

EXHAUST GAS RECIRCULATION APPARATUS FOR DIESEL ENGINE

BACKGROUND OF THE INVENTION

The present invention relates to an improvement in an exhaust gas recirculation or EGR system for a diesel engine.

It is well known to recirculate exhaust gas in a diesel engine back to the intake in order to reduce the concentration of toxic nitrogen oxides or NOx emitted therefrom.

Such recirculation of engine exhaust tends to produce an increase in the emission of smoke and unburned hydrocarbon or HC. It is therefore necessary to minimize or virtually stop exhaust gas recirculation in a heavy load operating range of the engine wherein the emission of smoke is considerable.

A conventional and typical system to meet the above demand employs means for sensing heavy load operation and cutting off the supply of control vacuum to a vacuum actuator associated with an EGR valve in the specific heavy load operating range, thereby interrupting the recirculation of engine exhaust.

However, although the heavy load condition may be sensed during rapid starting or rapid acceleration of a vehicle to immediately cut off the control vacuum, the exhaust gas recirculation frequently fails to be immediately interrupted. The result is the emission of increased amounts of smoke and unburned HC and CO during rapid starting of the vehicle.

Suppose that the accelerator pedal is depressed from a position corresponding to light load to the maximum depressed position for a quick start of the vehicle. Although this may be immediately responded to by specific means which sense the heavy load condition through the position of a control lever of a fuel injection pump operatively connected to the accelerator pedal, the control vacuum in the vacuum actuator (diaphragm assembly) of the EGR valve still remains therein. The EGR valve does not rapidly close but closes gradually as the control vacuum leaks from the vacuum actuator.

Thus, despite the full depression of the accelerator pedal and the maximum volume of fuel injection, engine exhaust is recirculated back to the intake until the EGR valve fully closes. This is the cause of the sharp increase in the emission of smoke and unburned HC and CO.

SUMMARY OF THE INVENTION

An object of the present invention is to provide an EGR system for a diesel engine which prevents increases in the smoke and HC and CO concentrations during rapid starting while preserving the effect of reducing NOx emission at and in the neighborhood of idling operation.

An exhaust gas recirculation apparatus for an engine embodying the present invention has an intake manifold and an exhaust manifold, and is characterized by comprising a first exhaust recirculation passageway connected between the intake manifold and the exhaust manifold for constant exhaust gas recirculation, a second exhaust gas recirculation passageway connected between the intake manifold and the exhaust manifold, valve means disposed in the second exhaust gas recirculation passageway, sensor means for sensing an idling condition and a heavy load condition of the engine, and control means responsive to the sensor means for closing the valve means when the sensor means senses one of the idling condition and the heavy load condition and opening the valve means when the sensor means does not sense both the idling condition and the heavy load condition.

In accordance with the present invention, a predetermined amount of exhaust gas recirculation is constantly provided through a first passageway connected between an engine intake manifold and an exhaust manifold. A vacuum actuated valve constitutes a second passageway which is connected in parallel with the first passageway. The valve is opened to allow exhaust gas recirculation through the second passageway except during idling and heavy load operation of the engine, thereby preventing excessive emission of smoke under these conditions.

It is another object of the present invention to provide a generally improved exhaust gas recirculation apparatus.

Other objects, together with the foregoing, are attained in the embodiment described in the following description and illustrated in the accompanying drawing.

DESCRIPTION OF THE PREFERRED EMBODIMENT

While the exhaust gas recirculation apparatus of the present invention is susceptible of numerous physical embodiments, depending upon the environment and requirements of use, substantial numbers of the herein shown and described embodiment have been made, tested and used, and all have performed in an eminently satisfactory manner.

Figure 1:
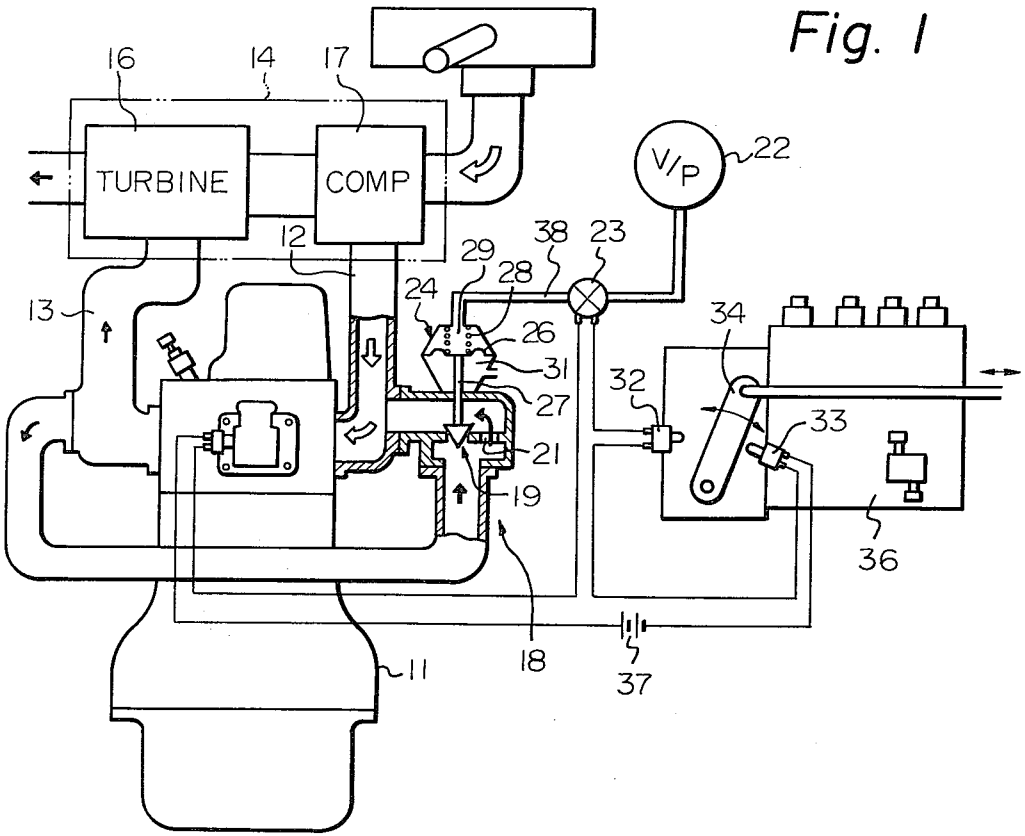
FIG. 1 schematically shows an EGR system according to the present invention.

Referring to FIG. 1, there is shown a diesel engine 11 having an intake manifold 12 and an exhaust manifold 13. A turbocharger 14 is associated with the engine 11 and has a turbine 16 driven for rotation by the engine exhaust and a compressor 17 operated by the turbine 16 to compress intake air. The turbocharger 14 thus supercharges air flowing to the intake manifold 12.

The reference numeral 18 denotes an exhaust gas recirculation or EGR passageway which extends from the exhaust manifold 13 upstream of the turbine 16 to the intake manifold 12 down stream of the compressor 17.

The EGR passageway 18 has therein in parallel relation an EGR valve 19 and a constant orifice 21 bypassing the EGR control valve 19 which constitute second and first passageways respectively.

A control vacuum from a vacuum pump 22 is selectively communicated to the EGR valve 19 through an electromagnetic valve 23.

The EGR valve 19 is furnished with a diaphragm assembly 24 having a flexible diaphragm member 26. The diaphragm 26 is connected to one end of a valve rod 27 so as to pull it up against the action of a spring 28 in accordance with the control vacuum in a vacuum chamber 29 of the assembly 24.

The diaphragm 26 of the assembly 24 defines at its other side an atmospheric chamber 31 which communicates with the atmosphere.

The constant orifice 21 serves to constantly recirculate a small volume of engine exhaust gas through the EGR passageway 18.

The constant orifice 21 causes exhaust gas recirculation even in a very light load range (idling and its vicinity) and a heavy load range thereby reducing the concentration of nigrogen oxides or NOx in the exhaust gas.

It will be understood that the EGR rate through the constant orifice 21 is controlled accurately despite the fact that it is preselected to be relatively small to avoid emission of smoke in the heavy load range.

Should an EGR valve be employed to control such a small rate of exhaust gas flow, strict control over the valve precision and operating characteristics would be required at the stage of production. The control with the constant orifice 21 enables far higher productivity because it needs precision only in the effective cross-sectional area of the constant orifice 21.

Operation of the electromagnetic valve 23 is controlled by a pair of switches 32 and 33 each of which is opened and closed depending on the position of a control lever 34 of a fuel injection pump 36. The control lever 36 is operatively connected to an accelerator pedal (not shown).

Figure 2:
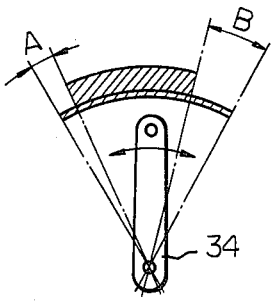
FIG. 2 is a fragmentary enlarged view of a part of FIG. 1 and shows various angular position zones of a control lever.

As best shown in FIG. 2, the switch 32 is a limit switch responsive to a very light load condition. The switch 32 is opened when the control lever 34 has an angular position within the range A between the vicinity of the idling opening (high idling opening somewhat larger than the idling opening) and the full closed position (idling opening), otherwise remaining closed.

The second sitch 33 is opened when the control lever 34 is within the range B between medium and heavy load ranges approximate to the full open position and the heavy load range. In the light and medium load ranges other than those mentioned, the switch 33 is closed.

The switches 32 and 33 are connected in series between the electromagnetic valve 23 and a power supply or battery 37. The valve 23 is disposed in a conduit 38 which communicates vacuum from the vacuum pump 22 to the vacuum chamber 29 of the diaphragm assembly 24. When both of the switches 32 and 33 are closed, the valve 23 is opened to pass the vacuum from the vacuum pump 22 to the EGR valve 19 for opening the valve 19 and increasing the amount of exhaust gas recirculation. When either one of the switches 32 and 33 is opened, the valve 23 introduces atmospheric pressure into the chamber 29 to close the valve 19.

The exhaust gas recirculation apparatus thus constructed operates as follows.

During idling of the engine, the switch 32 is opened to cause the valve 23 to cut off the supply of vacuum while introducing atmospheric pressure into the diaphragm assembly 24. As a result, the EGR valve is brought to its full closed position.

Under this condition, recirculation of exhaust gas takes place only through the constant orifice 21 of the EGR passageway 18.

In low and medium load ranges of the engine 11, the control lever 34 of the fuel injection pump 36 is between the switches 32 and 33 and remains clear thereof. The switches 32 and 33 are thus closed causing the valve 23 to admit vacuum from the pump 22 to the assembly 24.

In this case, the EGR valve 19 is in its full open position so that the EGR rate becomes the sum of the flow rate through the EGR valve 19 and that through the constant orifice 21.

In the heavy load range of the engine, the switch 33 is opened and the EGR valve 19 is again closed to permit exhaust gas recirculation only through the constant orifice 21.

When the accelerator pedal is rapidly depressed from its full closed position to its full open position to abruptly accelerate the engine, the switch 32 is first opened and then the switches 32 and 33 are both closed for a moment whereupon the switch 33 is opened.

Accordingly, the diaphragm assembly 24 of the EGR valve 19 receives atmospheric pressure, then momentary vacuum, and again atmospheric pressure.

Despite the action of the vacuum, the EGR valve 19 remains closed during the rapid acceleration because such momentary and, additionally, delayed action of the vacuum cannot produce a force large enough to open the EGR valve 19.

It will be appreciated that, during rapid starting, the exhaust gas recirculation rate is small and is regulated by the constant orifice 21 and therefore positively prevents generation of smoke.

Figure 3:
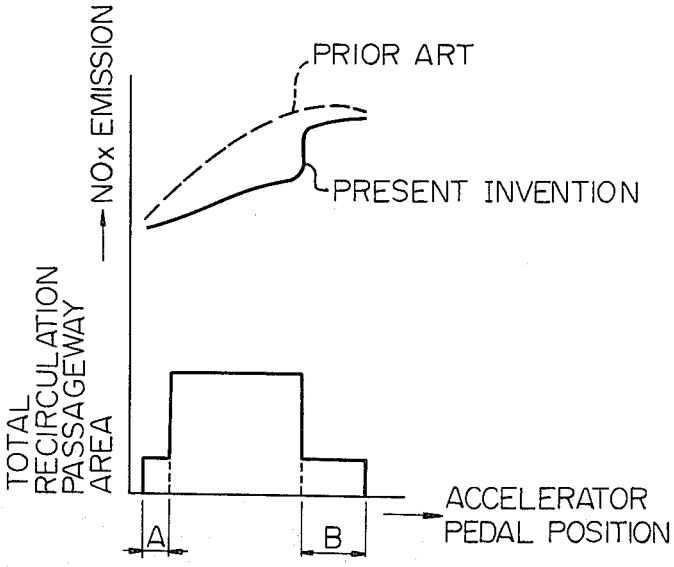
FIG. 3 is a plot demonstrating the relationship between the effective cross-sectional area of an EGR passageway and accelerator pedal position according to the present invention.

FIG. 3 is a plot demonstrating the relationship between the effective cross-sectional area of the EGR passageway 18 (total area of the EGR valve 19 and constant orifice 21) and the position of the accelerator pedal.

In summary, an EGR system according to the present invention prevents a control vacuum from remaining in a diaphragm assembly during rapid starting or acceleration and thereby allows and EGR valve to be kept closed even under such conditions. This avoids emission of smoke and increases in the HC and CO concentrations in the event of rapid starting.

During idling, the NOx concentration in the engine exhaust can be reduced without degrading the operation of the engine because a constant orifice regulates the exhaust gas recirculation.

It will be apparent that a system of the present invention is similarly applicable to engines without turbochargers.

Various other modifications will becomes possible for those skilled in the art after receiving the teachings of the present disclosure without departing from the scope thereof.

What is claimed is:

1. An exhaust gas recirculation apparatus for an engine having an intake manifold and an exhaust manifold, characterized by comprising:

a first exhaust gas recirculation passageway connected between the intake manifold and the exhaust manifold for constant exhaust gas recirculation;

a second exhaust gas recirculation passageway connected between the intake manifold and the exhaust manifold;

valve means disposed in the second exhaust gas recirculation passageway;

sensor means for sensing an idling condition and a heavy load condition of the engine; and control means responsive to the sensor means for closing the valve means when the sensor means senses one of the idling condition and the heavy load condition and opening the valve means when the sensor means does not sense either the idling condition or the heavy load condition;

the valve means comprising a vacuum operated valve, the first exhaust gas recirculation passageway being constituted by an orifice formed through the valve;

the engine comprising a fuel control member, the sensor means comprising switch means actuated by the fuel control member, the valve being entirely controlled by electrical signals from the switch means.

* * * * *